US008240949B2

(12) United States Patent
Weber

(10) Patent No.: US 8,240,949 B2
(45) Date of Patent: Aug. 14, 2012

(54) HAND-OPERATED CONCRETE CURB FORMING MACHINE

(75) Inventor: Douglas J. Weber, Rogers, AR (US)

(73) Assignee: Curb Shapers, Inc., Rogers, AR (US)

( * ) Notice: Subject to any disclaimer, the term of this patent is extended or adjusted under 35 U.S.C. 154(b) by 204 days.

(21) Appl. No.: 12/803,735

(22) Filed: Jul. 6, 2010

(65) Prior Publication Data

US 2012/0009014 A1 Jan. 12, 2012

(51) Int. Cl.
*E01C 19/22* (2006.01)

(52) U.S. Cl. ..... 404/97; 404/96; 404/98; 404/112

(58) Field of Classification Search ..... 404/96, 404/97, 98, 112, 120
See application file for complete search history.

(56) References Cited

U.S. PATENT DOCUMENTS

| | | | | | |
|---|---|---|---|---|---|
| 1,468,432 | A | * | 9/1923 | Wright et al. | 451/352 |
| 2,342,445 | A | * | 2/1944 | Allen | 404/112 |
| 2,629,210 | A | * | 2/1953 | Robinson | 451/353 |
| 2,900,883 | A | | 8/1959 | Dening | |
| 2,917,979 | A | * | 12/1959 | Dening et al. | 404/133.1 |
| 3,007,379 | A | | 11/1961 | Ellis | |
| 3,091,158 | A | * | 5/1963 | Bunger et al. | 404/112 |
| 3,458,885 | A | * | 8/1969 | Danielsson | 15/50.1 |
| 3,673,931 | A | | 7/1972 | Dening | |
| 3,910,738 | A | | 10/1975 | Chandler | |
| 4,217,065 | A | | 8/1980 | Stilwell | |
| 4,544,346 | A | | 10/1985 | Allen | |
| 4,719,659 | A | * | 1/1988 | Urakami | 15/49.1 |
| 5,354,189 | A | | 10/1994 | McKinnon | |
| 5,499,406 | A | | 3/1996 | Chalberg | |
| 5,803,656 | A | | 9/1998 | Turck | |
| 5,846,176 | A | | 12/1998 | Zieger | |
| 6,238,277 | B1 | * | 5/2001 | Duncan et al. | 451/271 |
| 6,474,906 | B1 | | 11/2002 | Cunningham | |
| 6,863,470 | B2 | | 3/2005 | Eggleton | |
| 7,033,258 | B2 | * | 4/2006 | Jordan | 451/350 |
| 7,296,948 | B2 | * | 11/2007 | Mikhaylenko | 404/118 |
| 7,563,156 | B2 | * | 7/2009 | Anderson | 451/353 |
| 7,621,694 | B1 | | 11/2009 | Goodman | |
| 2002/0021938 | A1 | | 2/2002 | Matthias | |
| 2005/0238745 | A1 | | 10/2005 | Allen | |
| 2010/0021235 | A1 | | 1/2010 | Goodman | |

* cited by examiner

*Primary Examiner* — Gary S Hartmann
(74) *Attorney, Agent, or Firm* — Stephen D. Carver

(57) ABSTRACT

A hand-controlled, curb forming machine that is transformable between different widths and geometries, and between different wheel configurations, to accommodate different concrete curbing. A downwardly projecting, rotating head that rotates about an axis perpendicular to the slab shapes raw concrete into appropriately styled and contoured curbs. A machine frame slidably receives an adjustable, wheeled subframe. A roller on the opposite frame side rides on an opposite curb form. A pivoted handle is reversible. The electric motor is adjustably secured to the frame by a mounting plate movable within follower slots in the frame. A removable adaptor plate disposed on an opposite frame end supports the machine when not in use, but can be removed for normal curb work exposing a form riding roller. When the machine is deployed with monolithic curbs without rebar, the adaptor plate can mount to the subframe to raise the machine by lowering the wheels.

17 Claims, 11 Drawing Sheets

HAND-OPERATED CONCRETE CURB FORMING MACHINE

BACKGROUND OF THE INVENTION

1. Field of the Invention

The present invention relates generally to power tools for treating and shaping concrete. More particularly, the present invention relates to portable, hand operated power tools for shaping green concrete into curbs.

2. Description of the Related Art

Concrete curbs form structural borders upon peripheries of concrete streets or parking lots where aesthetics are important. Appropriate concrete curbing is often integral with gutter structures that contribute to proper drainage. Additionally, residential property owners often employ decorative edging along borders to enhance the appearance of their landscaping. Properly formed curb and gutter designs add valuable structural and functional attributes to modern concrete structures as well. In many communities properly designed curbs and gutter arrangements are required by zoning ordinances.

A wide variety of curb forming techniques thus exist. Concrete shaping systems and curb forming devices can contact freshly placed concrete directly, while still green in a slab, or concrete curbing can be extruded with a variety of placement devices.

Some large scale, motor driven curb forming devices store concrete in a hopper, and pump it outwardly through shaping dies, molds or extruder equipment that preshapes the curb. Some larger, wheeled systems used to strike-off or screed large slabs traverse forms or rails for support. Many include ancillary curb installers that shape slab edges as concrete is laid.

So-called slip-forming machines have been adapted to lay concrete curbing or curb and gutter arrangements during slab pouring and screeding. Typical slip forming machines follow the length of the slab and store wet concrete in a hopper. Concrete discharged from or forced out of the hopper is shaped by a form proximate the hopper that moves with the machine. As the form compresses and shapes the concrete edges, a properly shaped curb or curb and gutter combination is formed in place.

For example, U.S. Pat. No. 4,544,346 issued Oct. 1, 1985 illustrates curb forming apparatus associated with a screed. The screed treats plastic concrete and forms a curb along one or both sides of the slab as the screed travels the slab length. The triangular truss concrete screed has first and second sides supported by rollers which engage spaced apart forms. The screed traverses the entire width of the slab, and is supported upon forms, and is not hand operated by a single worker. A curb form is coupled to one side of the finishing machine.

U.S. Pat. No. 4,217,065 issued Aug. 12, 1980 discloses a slip-form curb and gutter machine with a wheeled chassis that travels along tracks. A concrete receiving hopper discharges green concrete that is shaped by suitable forms affixed to the chassis. A hand winch above the hopper attaches to a cable for pulling the machine along its tracks. An operator can stand on a platform disposed above the form.

U.S. Pat. No. 5,803,656 issued Sep. 8, 1998 discloses a motorized concrete screed with a roller attached to a chassis. A pair of handles extending from the chassis are independently adjustable. A throttle attached to one of the handles is electrically connected to the motor. A pair of wheel assemblies permit the apparatus to be easily moved to and from a worksite without damaging the roller.

Slip-form machines and large screeding devices involve expensive, heavyweight equipment, and they are too expensive and cumbersome for smaller contractors to set up and use economically, particularly on smaller jobs. Because of the disadvantages with large slip form machines and screeds, smaller hand operated machines have evolved for treating concrete and shaping it into gutters or curbs. Some use motor driven carriages that, like slip form machines, include hoppers that discharge concrete into molds or shapers that compress the concrete into a desired shape. Some analogous devices use a U-shaped handle arrangement, that journals a rotatable roller whose periphery contacts the concrete for shaping.

For example, U.S. Pat. No. 3,910,738 issued Oct. 7, 1975 discloses a concrete finishing roller rotatably mounted on an axle that is controlled by a handle. Indicia formed on the outer periphery of the roller imprints the concrete surface. Workers can manipulate the handle so that the roller may be pushed across green concrete. The depth of the impression made in the concrete surface may be varied by the addition or the removal of weights on the handle and by vibrating the roller in a vertical plane as it moves across the concrete surface.

U.S. Pat. No. 5,354,189 issued Oct. 11, 1994 discloses a concrete forming device for extruding curb, barrier, wall, gutter or the like from concrete or cement. Cement stored within a vibrating hopper falls onto tapered, counter rotating augers which compact and force the concrete through an adjacent extrusion mold for shaping.

U.S. Pat. No. 5,846,176 issued Dec. 8, 1998 also shows a hand-operated roller tool for concrete finishing. A hollow, cylindrical, roller secured journalled to a U-shaped frame has protrusions or nubs defined about its outer surface to produce a desired texture on the green concrete. A single worker can operate the device with a handle coupled to the frame.

U.S. Pat. No. 6,474,906 issued Nov. 5, 2002 discloses a concrete finishing machine wherein a roller extends between a primary motorized unit and a secondary unmotorized unit disposed on each side of a slab to be paved. An engaging lever must be pressed to initiate tube rotation, driving the primary and secondary units forward.

U.S. Pat. No. 6,863,470 issued Mar. 8, 2005 provides a curbing apparatus for shaping green concrete by pushing it through a channel defined by a mold.

U.S. Pat. Application No. 20020021938 published Feb. 21, 2002 discloses a curb forming and extruding machine includes a plunger that forces raw concrete via lower hopper into and through a curb extrusion mold.

U.S. Pat. No. 7,621,694 issued Nov. 24, 2009 discloses a curb forming machine using a single, rotatable curb-forming roller. A handle assembly is utilized for pulling and maneuvering the roller, and a motor rotates the roller to shape and smooth wet concrete into curbing.

U.S. Pat. No. 5,449,406 issued Sep. 12, 1995 discloses a machine for applying grout mortar to a tiled surface. A frustroconical shroud having a plurality of generally radially extending blades rotates about an axis that is perpendicular to the surface being treated.

U.S. Pat. Application No. 20050238745 discloses an apparatus for impressing three-dimensional patterns in a slip-formed concrete wall. Impression rollers include outer peripheries provided with three-dimensional patterns. One roller coats a side of an exposed wall, and an ancillary roller coats the top of the wall.

Despite the advantages of relatively recently develop portable curb forming devices, they suffer from well known disadvantages. Often they have to be made flush with available forms, and hand controlled designs with large rollers are difficult to guide and control. Irregular patterns and misshapen concrete edges can thus result. Changing the operating direction is difficult, because handles and frames, including wheeled carriages where used, are designed to move in only one direction. Further, where rollers are placed horizontally to help propel the apparatus, and rotate in an axis parallel with the plane of the slab, curb deformation and uneven spots can occur when the unit suddenly jerks in response to tight turns in smaller pours.

BRIEF SUMMARY OF THE INVENTION

This invention provides an improved, portable, hand controlled concrete curbing machine. Curb shaping is effectuated by a specially shaped head that rotates about an axis that is perpendicular to the slab. The head projects downwardly from a self propelled, wheeled carriage whose width and dimensions can be user adjusted or configured by the user to fit many diverse curbing applications faced by the small contractor.

The curb forming machine comprises a rectangular frame comprising inturned edges that slidably receive an adjustable subframe supporting a pair of wheels that can ride on a form. The subframe is user adjustable, so machine width can be selected to best fit the job application. A roller on the opposite frame side rides on the opposite curb form. Concrete is formed by a shaping head rotating beneath the frame driven by an electric motor. The motor is adjustably secured to the frame by a mounting plate secured beneath the frame by fasteners received within follower slots in the frame that slidably adjust position.

An optional, removable adaptor plate is disposed on an opposite frame end to support the machine when in transit or storage. It is removed for normal curb work. Te adaptor plate can raise the machine from for monolithic curbs without rebar by supporting the normal wheels, an effectively lowering them to ride o the ground. A roller behind the adaptor plate is exposed when the plate is removed, and it rides along forms when normal curb and gutter work is undertaken. Preferably the handle assembly is "offset" from the machine center to aid in operator control.

It is therefore a primary object of the present invention to provide a portable, one-man, self-propelled curb forming device that is ideal for smaller jobs.

It is also important to provide a curb-forming machine of the character described that is highly stable.

It is also an object to provide a transformable curb forming machine that can be user switched between jobs of different dimensions, and which can be switched between normal curb-and-gutter applications and monolithic curb jobs.

Another object is to provide a curb former of the character described that finishes and shapes plastic concrete and forms a curb with a desired size and shape.

Another important object is to enable contractors to use a single adjustable machine for either finishing normal curb and gutter work, or for finishing monolithic curbs.

A further object is to provide a powered, self propelled curb-forming apparatus which can easily be reversed in the direction of travel.

Another object of the present invention is to provide a motor-powered, curb-forming machine which is inexpensive, relatively lightweight, easy to use, and ideal for smaller contractors.

Yet another object is to provide a transformable curb and gutter machine that can be quickly and easily switched between job applications in the field without special tools or equipment.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
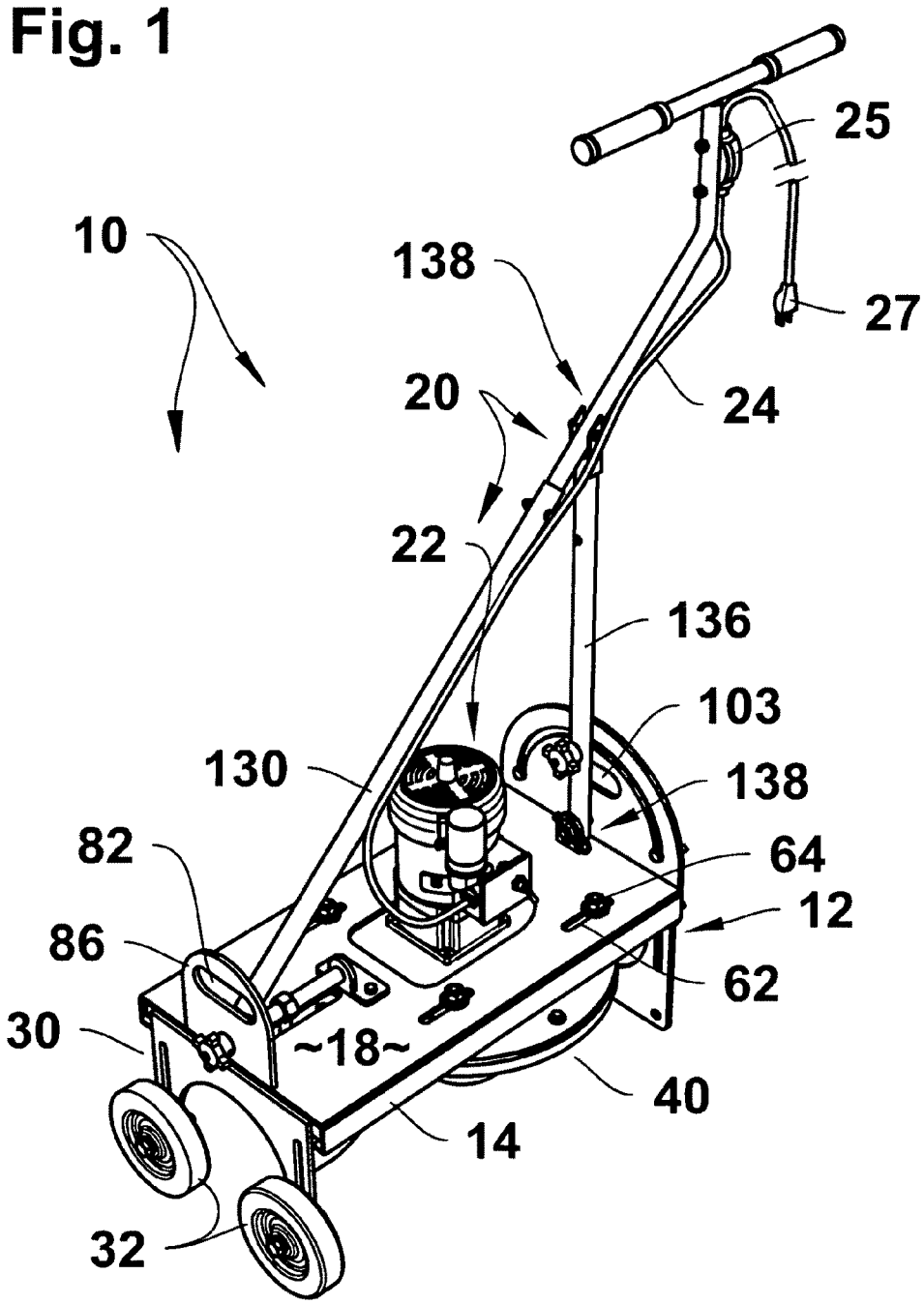
FIG. 1 is a rear isometric view showing the best mode of my new concrete curb forming machine.

With initial reference directed now to FIGS. 1-3 and 9 of the appended drawings, a concrete curb forming machine constructed generally in accordance with the best mode of the invention has been generally designated by the reference numeral 10. The curb former machine 10 is adapted to traverse wet or freshly laid concrete, preferably disposed between parallel and slightly elevated forms, for shaping edges or boundary regions of the slab into arcuate curbs of appropriate shape and dimensions. The machine 10 can be used by a single workman, and it is portable, enabling quick transportation between job sites.

The curb forming machine comprises a rigid, generally rectangular frame 12 somewhat in the form of a flat parallelepiped. The frame 12 has downwardly depending front and rear edges 14 (FIG. 1) and 16 (FIG. 2) respectively. (Since the handle can be adjusted to face either direction, these edges 14 and 16 can each be referred to as either "font" or rear.") Various components are mounted on the upper surface 18 (FIGS. 1, 2, 5) atop the frame 12. A handle assembly 20 is pivotally and adjustably mounted to the frame 12 at opposite frame ends, as will later be described in detail. An electric drive motor 22 (FIGS. 1, 2) secured to frame 12 is powered by a conventional electrical cord 24 (FIGS. 1, 2) that is secured to the handle assembly 20 and controlled by a conventional switch 25. Conventional 120 V.A.C. power is supplied by plug 27.

As described in detail hereinafter, a rigid, subframe 30 supporting a pair of main wheels 32 is adjustably, slidably coupled to the right side of the frame 12. In use, these wheels normally ride on a two inch by six inch toe board form, which is used in normal curb and gutter work. The opposite end of the frame supports a removable and adjustable adaptor plate 36 (FIGS. 2, 3) that normally supports the machine 10 when not in use.

Figure 3:
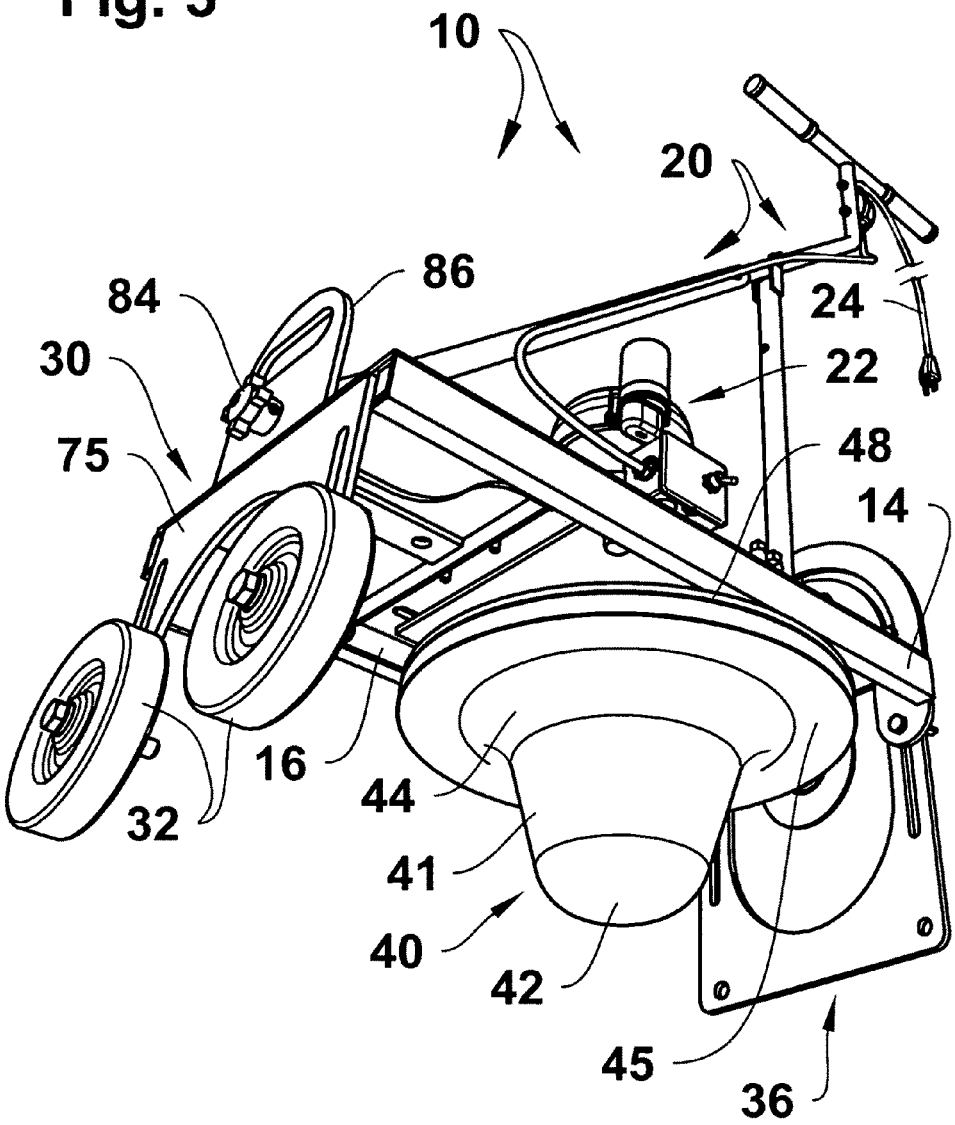
FIG. 3 is a rearward bottom isometric view thereof.
Figure 4:
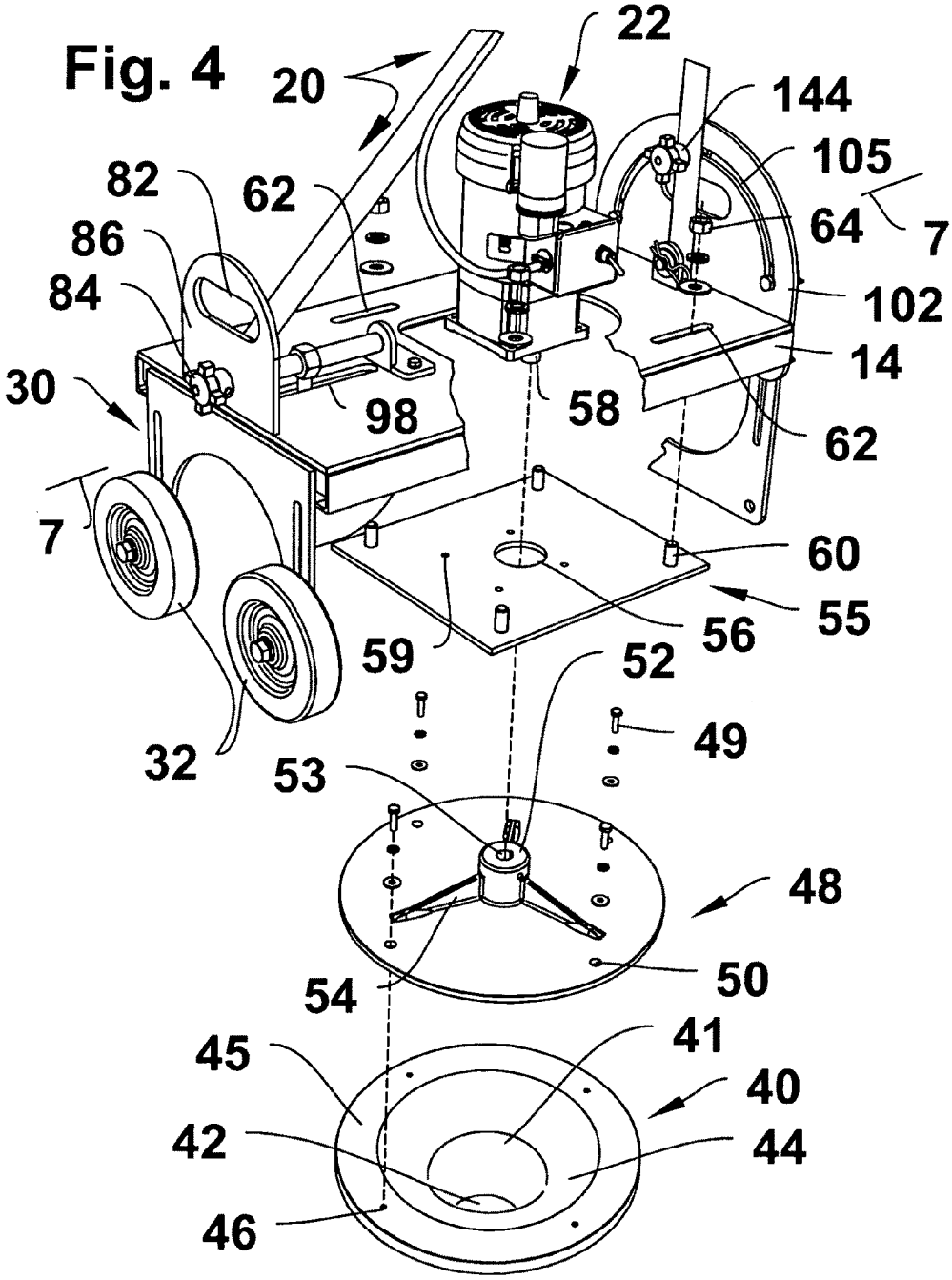
FIG. 4 is a partially exploded, fragmentary isometric view thereof, with portions thereof broken away for clarity or omitted for brevity.

Concrete is contacted by and formed by a replaceable shaping head 40 operationally disposed beneath frame 12. Motor 22 is amounted atop frame 12 proximate surface 18. As best seen in FIGS. 3 and 4, the shaping head 40 is a hollow, hat-like structure, preferably molded from plastic. Head 40 has a body 41 (FIG. 3) substantially shaped like an inverted, truncated cone, and an integral, convex cap portion 42 that projects downwardly. An integral, circular ridge portion 44 transitions between body 41 and an integral, ring shaped flange 45 that includes a plurality of radially spaced-apart mounting orifices 46 (FIG. 4). A circular drive plate 48 above head 40 is concentrically secured to flange 45 on head 40 by fasteners 49 that penetrate orifices 50 and the aligned orifices 46 in head flange 45. Plate 48 has a central, cylindrical drive hub 52 that is reinforced by a plurality of webs 54.

A rigid, square motor mounting plate 55 above drive plate 48 has a central orifice 56 through which hub 52 rotatably projects. The hub key orifice 53 is penetrated by motor output shaft 58 (FIG. 4) that is coaxially aligned with orifices 53 and 56 and hub 52. Shaft 58 thus establishes an axis of rotation for itself and the shaping head 40 that is perpendicular to the slab surface. Motor 22 is attached to mounting plate 55 with suitable fasteners (not shown) that penetrate orifices 59 in mounting plate 55 (FIG. 4). Importantly, motor mounting plate 55 can be adjusted lengthwise across frame 12 (i.e., towards or away from the ends of the machine frame 12. To this effect there are a plurality of standoffs 60 (FIG. 4) that project upwardly, generally from the corners of mounting plate 55, and register with elongated adjustment slots 62 defined in the surface 18 of frame 12. Suitable fasteners 64 (FIG. 1) penetrate frame adjustment slots 62 and secure the head 40 and motor 22 in a desired position. Widthwise adjustment in head placement is thus possible, by loosening fasteners 64, shifting the motor and the head 40 below along the frame 12, and then retightening the fasteners 64.

Figure 5:
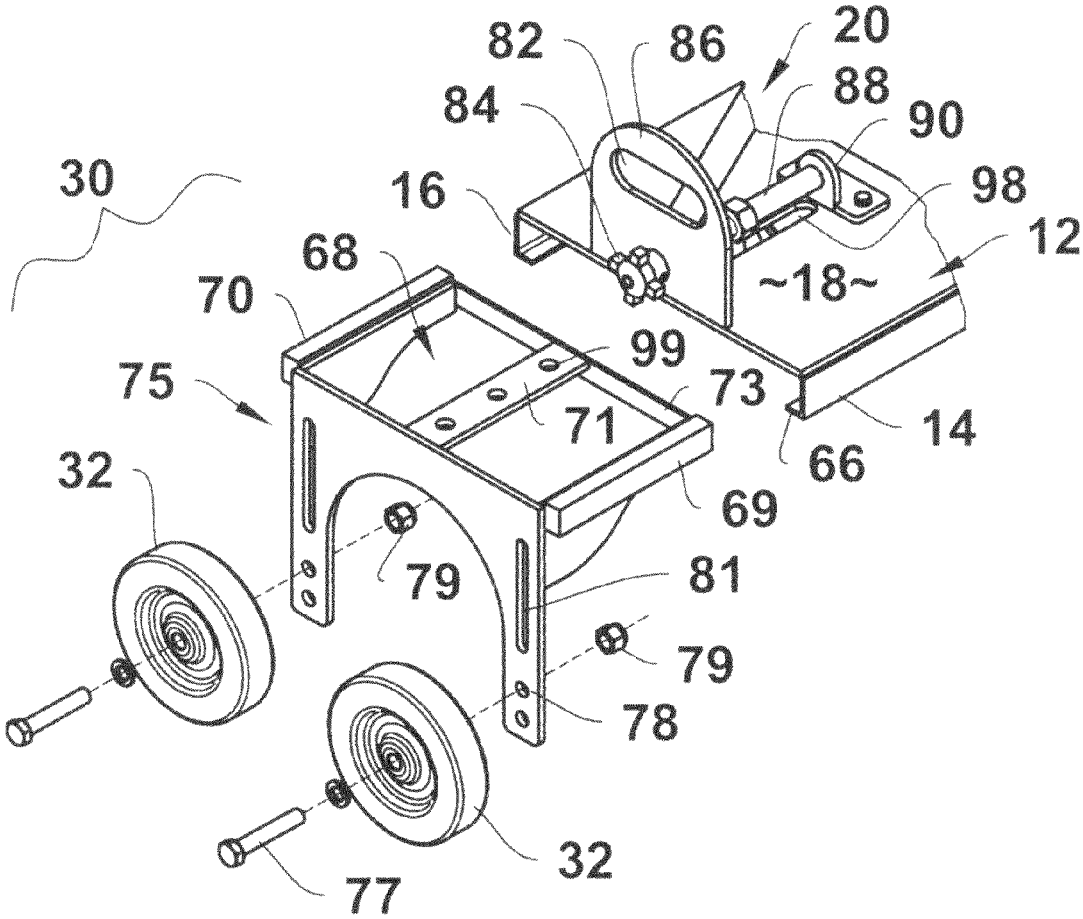
FIG. 5 is an enlarged, partially exploded, fragmentary isometric view showing the preferred adjustable subframe and the wheels.
Figure 6:
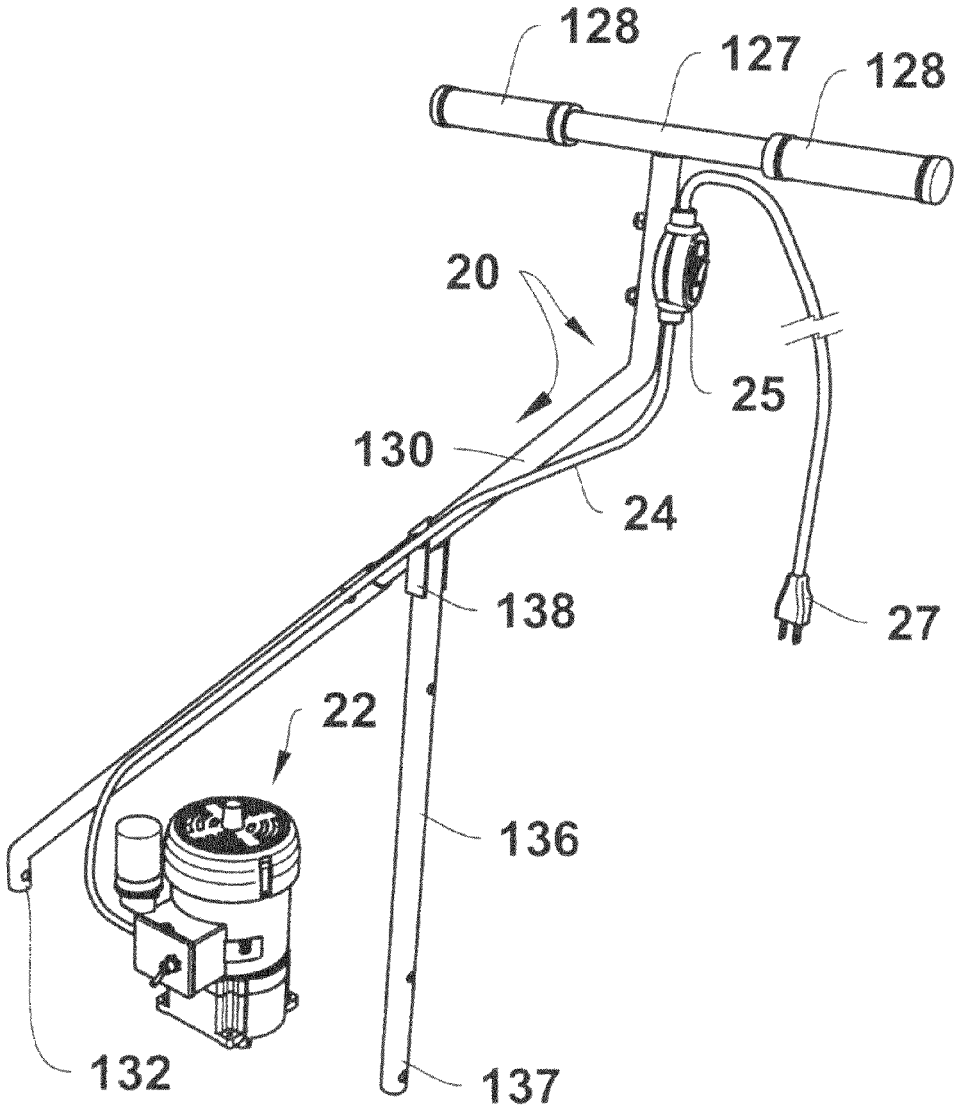
FIG. 6 is an enlarged, partially exploded, isometric view showing the preferred handle assembly.

With joint reference now to FIGS. 5 and 6, the preferred subframe 30 is also adjustably attached to the frame 12. The edges 14, 16 of the frame 12 have inwardly turned lip portions 66 (FIG. 5), forming a generally C-shaped cross section. Subframe 30 has a generally rectangular top 68, bounded by spaced apart, parallel end rails 69, 70, that ride within and are captivated between frame edges 14 and 16 in assembly (FIG. 5). A subframe reinforcement 71 extends between a side strut 73 and a generally U-shaped wheel mounting plate 75. The main wheels 32 previously described can be secured to plate 75 with bolts 77 that penetrate the wheels and mounting orifices 78 in plate 75, being secured with nuts 79. Preferably there are elongated mounting slots 81 formed in the legs of plate 75 above wheel orifices 78 that slidably accommodate extra large wheels for clearance where necessary.

Subframe 30 is moved relative to frame 12 by a hand-operated adjustment knob 84. As seen in FIG. 5 for example, there is a U-shaped flange 86 projecting upwardly from the end of frame 12. An elliptical orifice 82 (FIGS. 2, 4, 5) in the arcuate flange 86 provides a connection point for lifting. One end of a threaded shaft 88 (FIG. 7A) penetrates flange 86 and is secured to drive knob 84, and the opposite end rotatably terminates in an L-bracket 90 (FIG. 7A) that is secured to frame surface 18 by a fastener 91. A downwardly projecting traveler 93 has a threaded collar 94 threadably mated to shaft 88, so that rotation of the knob 84 moves the traveler 93. The lower shank 96 of the traveler 93 penetrates an elongated slot 98 (FIGS. 4, 5) formed in frame 12, and is attached to subframe 30 to move main wheels 32 inwardly or outwardly relative to the motor 22. Specifically, traveler shank 96 penetrates and is fastened to a selected orifice 99 (FIG. 5) in the subframe reinforcement strut 71. Thus the main wheels 32 can be move inwardly or outwardly to change or adjust the effective width of the curb former 10, adapting it for use in diverse situations of varying dimensions and width.

Figure 8:
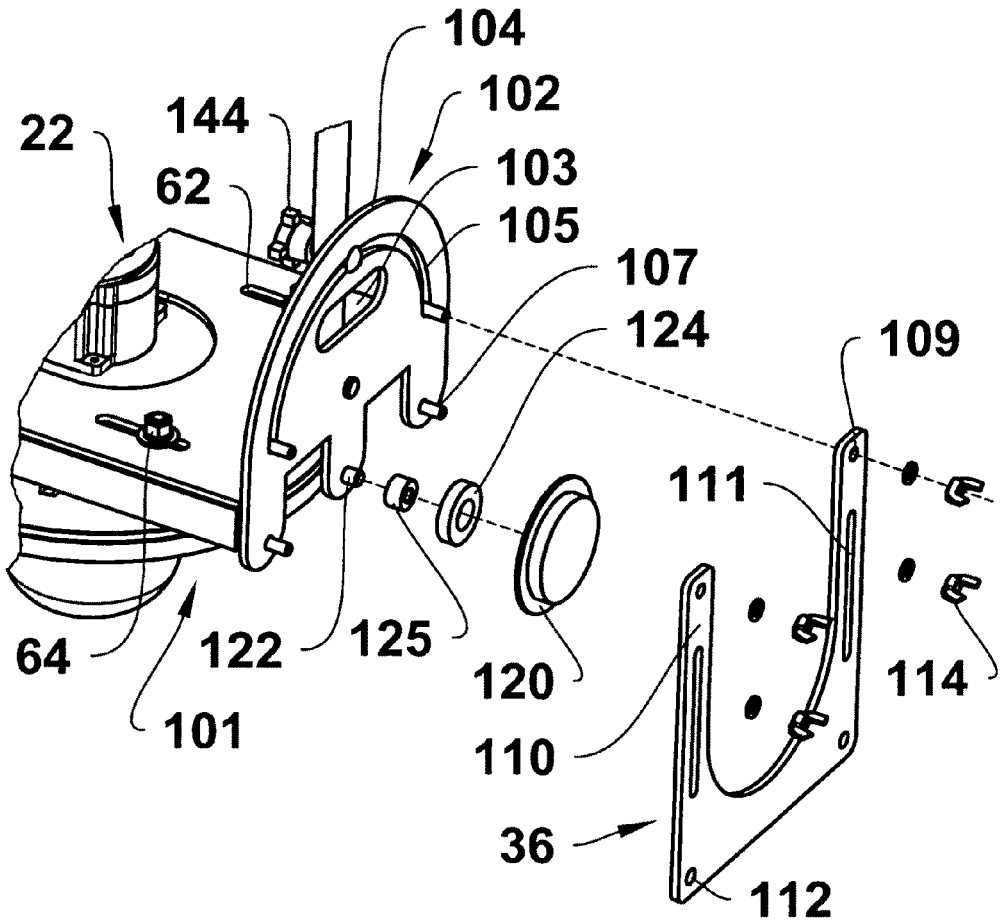
FIG. 8 is an enlarged, partially exploded, fragmentary isometric view showing the adaptor plate end of the frame; and, FIG. 9 is a rear elevational view thereof.

With reference now to FIGS. 1, 2 and 8, 9, there is an adaptor plate 36 disposed on the frame end 101 (FIGS. 2, 8) opposite wheels 32. The adaptor plate 36 is shaped generally "U-shaped" and when installed, it is mated to a bell shaped plate 102 (FIG. 8) secured at end 101 of the frame 12 (FIG. 8). Plate 102 has a curved top 104 bordering a curved follower slot 105 that is used by the handle assembly 20, as later described. A plurality of threaded studs 107 projecting outwardly from the plate 102 (FIG. 8) penetrate upper orifices 109 and aligned slots 111 in the legs 110 of adaptor plate 36. Hand-operable wing nuts 114 engage studs 107 to secure adaptor plate 36 to bell shaped plate 102. The elliptical orifice 103 provides a lifting point when used with similar orifice 82 in flange 86 (FIG. 4). Optional wheels can be attached to plate 36 with orifices 112.

The bell-shaped plate 102 also mounts a roller 120 (FIGS. 7A, 8) that is used with normal curb and gutter work with adaptor plate 36 removed from the machine. Roller 120 is secured to stud 122 on bell shaped plate 102, being journalled with bearing 124 and fastener 125 (FIG. 8.

Figure 2:
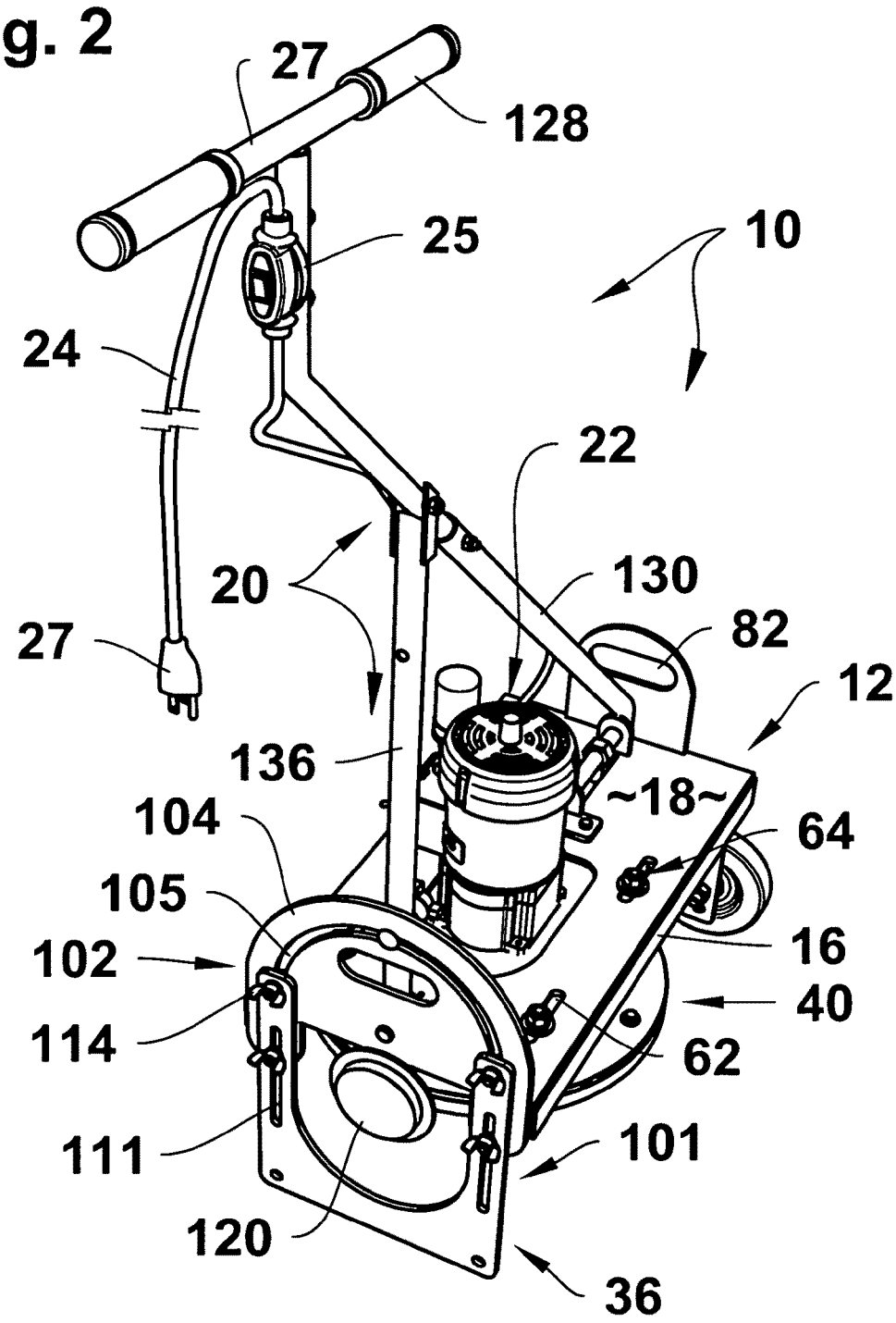
FIG. 2 is a frontal isometric view thereof.

The adaptor plate 36 has several functions. First, as illustrated in FIGS. 1 and 2 it supports the machine in a stable position for transportation or stowage. It is removed in use (i.e., FIG. 7A) for normal curb and gutter work. Finally, it can be raised or adjusted in position to support an auxiliary wheel for monolithic curb installations, (i.e., FIG. 7B).

Figure 9:
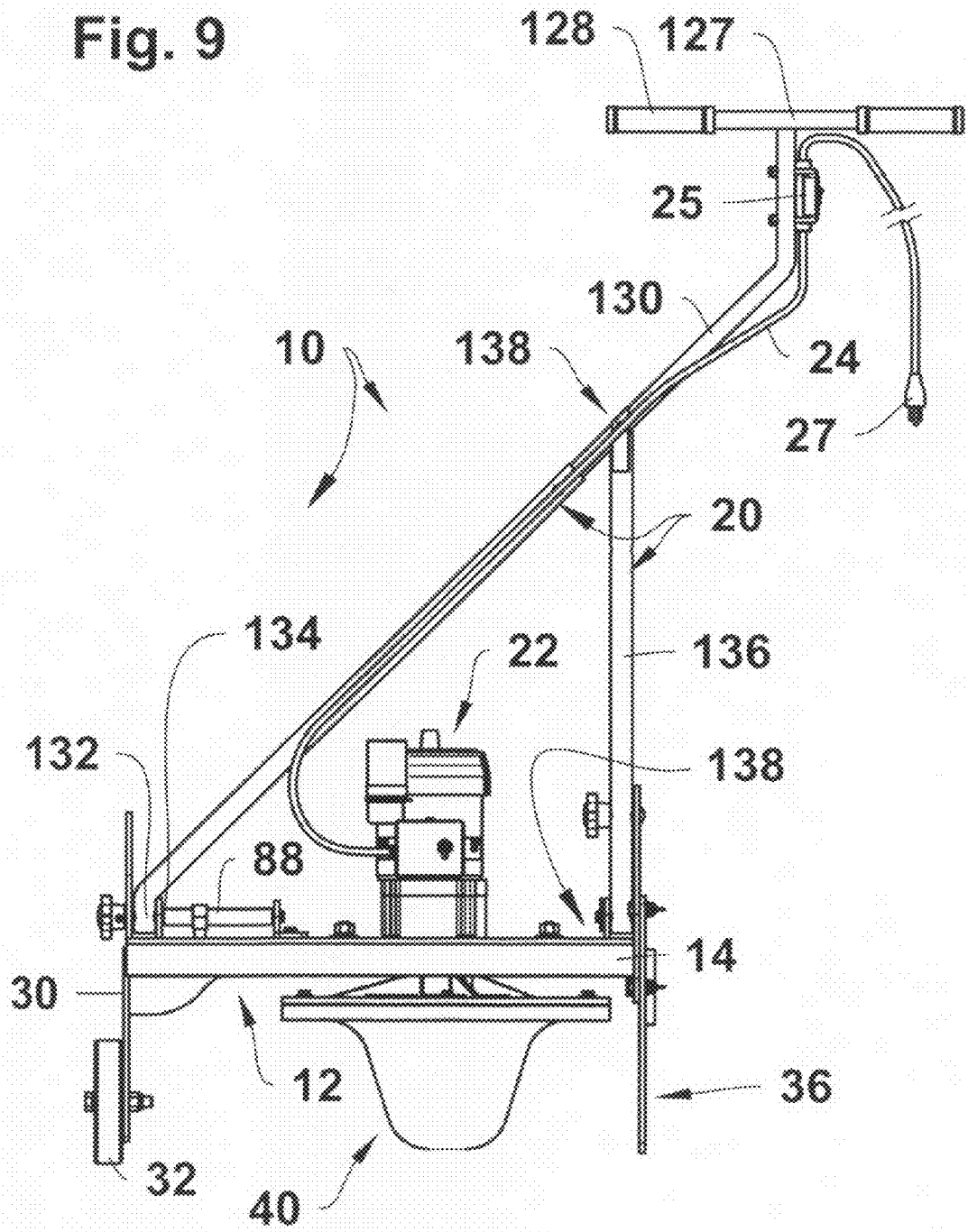

The handle assembly 20 can tilt in either direction, fore or aft of the motor 22, so that the curbing machine is easily reversible, from the point of reference of an operator, who pushes" forwardly" along an intended direction of travel with the handle assembly 20. As best appreciated from FIGS. 1, 2, 6, and 9, the handle assembly is "offset," in that the handlebar 127 and hand grips 128 are positioned towards the adaptor plate side 101, away from the motor 22. As best seen in FIG. 9, the handle assembly comprises an angled rod 130 extending angularly upwardly from a turned end portion 132 that is penetrated by shaft 88 (FIGS. 7A and 9) and rotatably secured within pivot bracket 134 (FIG. 9). A vertical handle portion 136 extends downwardly from junction 138, where it connects to handle rod 130, to another pivot bracket 138 (FIG. 7A) within which end 137 (FIG. 6) is journalled by pin 140 (FIG. 7A) and secured by fastener 142. The handle orientation is fixed by tightening an adjustment knob 144 that is threaded to carriage bolt 145 (FIG. 7A) that penetrates and tracks within follower slot 105 in bell-shaped plate 102 previously described. The head 147 (FIG. 7A) of carriage bolt 145 prevents axial escape of the bolt and insures proper tracking within the follower slot.

Figure 7A:
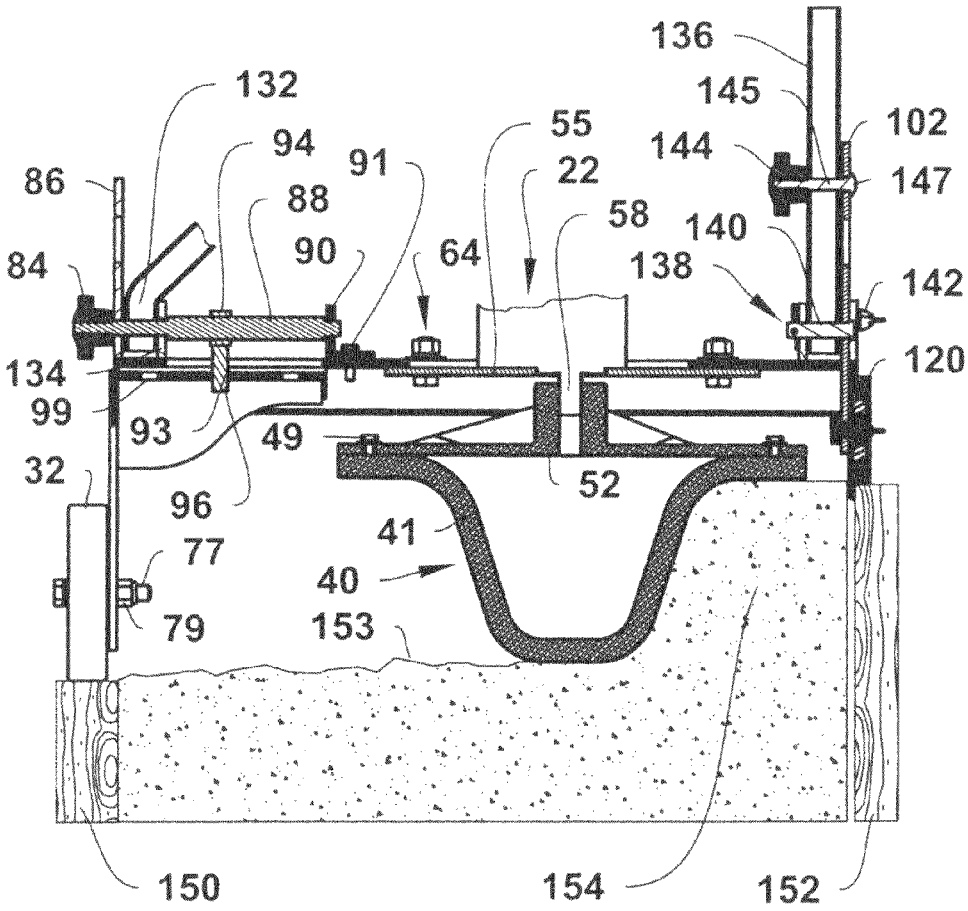
FIG. 7A is an enlarged, fragmentary, sectional view taken generally along line 7-7 of FIG. 4, with the adaptor plate removed, and showing the machine forming a curb and riding a two inch by six inch form on the left, and a two inch by twelve inch form on the right for normal curb and gutter work.
Figure 7B:
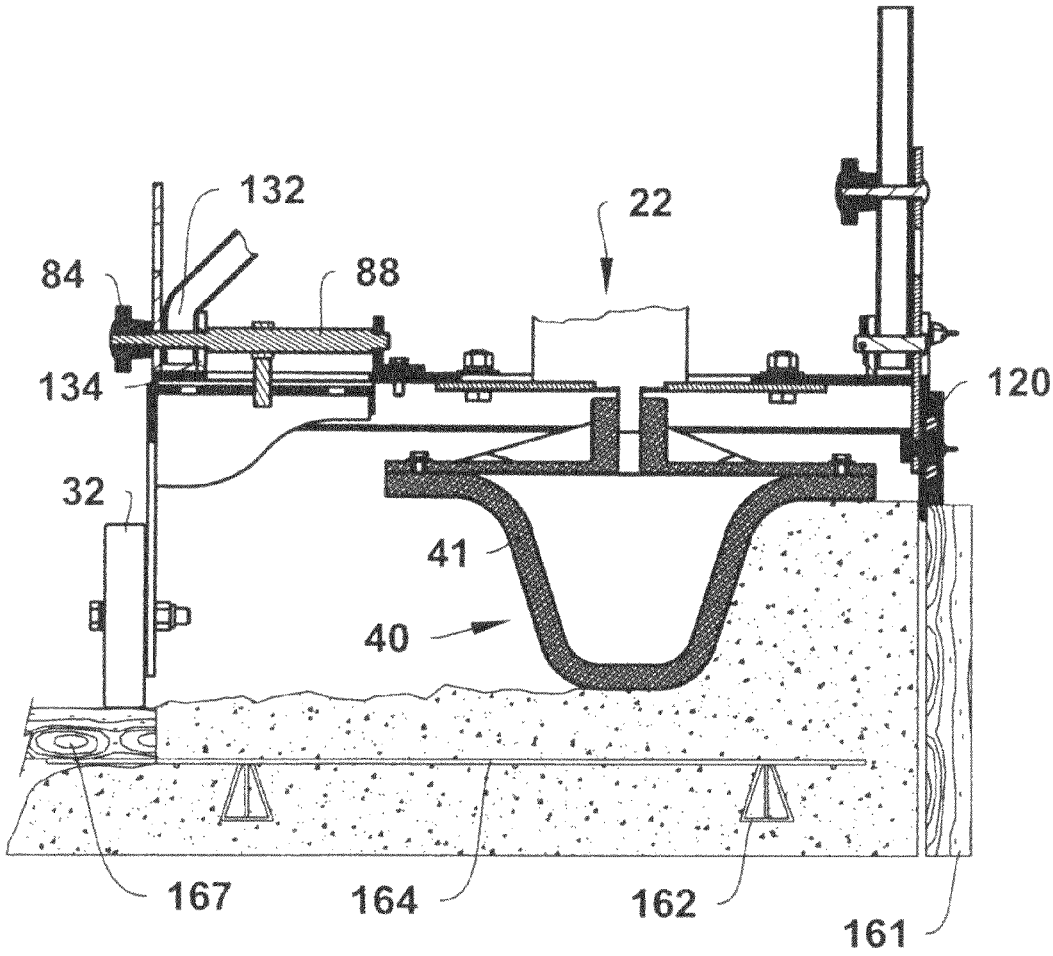
FIG. 7B is an enlarged, fragmentary, sectional view similar to FIG. 7A, with the adaptor plate removed, showing the machine in use with a monolithic curb with rebar.

FIGS. 7A and 7B illustrate actual use. In FIG. 7A the wheels 32 are riding upon a two-by-six inch toe board 150 that is substantially parallel with and spaced-apart from a two-by-twelve form member 152. Shaping head 40 penetrates downwardly into the concrete 153 and a concrete mass 154 is shaped by the rotating head 40 that creates a curb between itself and the form 152. It will be noted that for normal curb and gutter work, the adaptor plate 36 previously discussed has been removed, exposing the roller 120 mounted to plate 102 (FIG. 8) that rides atop form member 152. It should be appreciated that the head 40 is removable and selectable; differently shaped heads can be used for differently shaped curbs.

In FIG. 7B a monolithic curb is being formed. Here roller 120 rides atop a form member 161. Adaptor plate 36 is uninstalled. Within the raw concrete are rebar chairs 162 and a rebar mat 164. A form member 167 (FIG. 7B) contacts the rebar mat 164 and supports wheels 32.

Figure 7C:
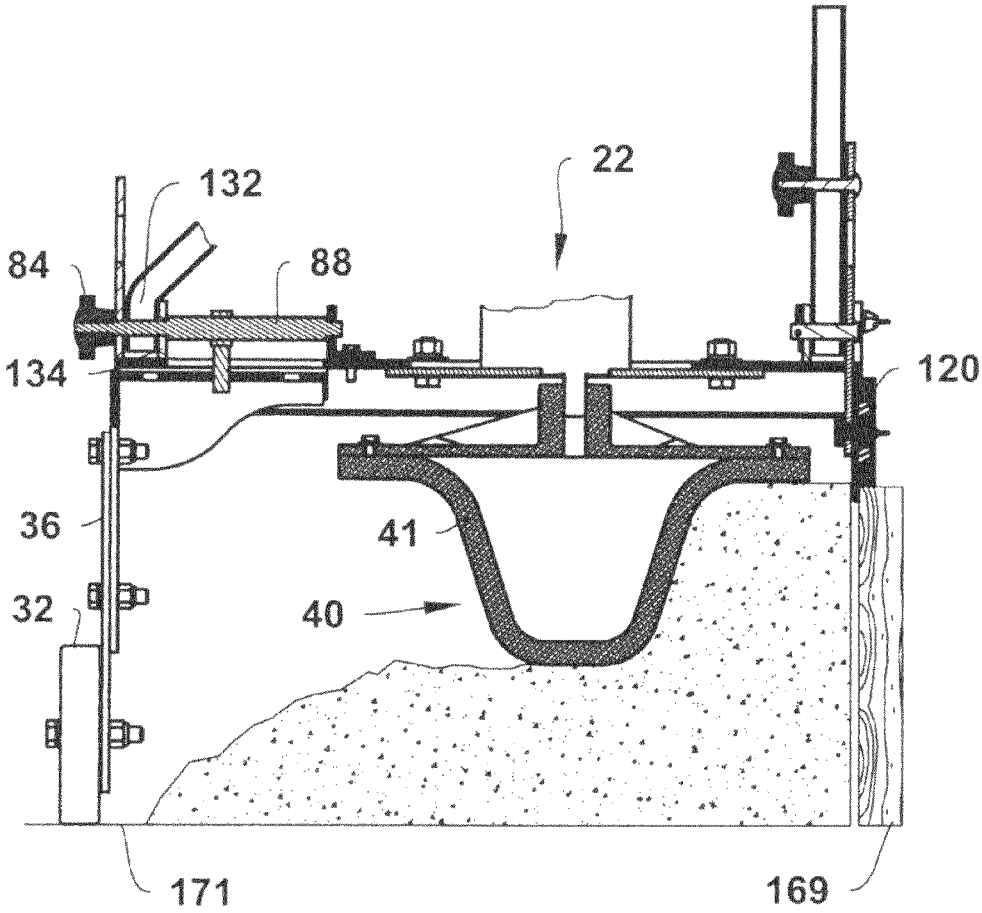
FIG. 7C is an enlarged, fragmentary, sectional view similar to FIGS. 7A and 7B, with the adaptor plate removed, showing the machine in use with a monolithic curb without rebar.

In FIG. 7C a monolithic curb without rebar is being formed. Here roller 120 rides atop a higher form member 169. Adaptor plate 36 is uninstalled from frame side 101 and placed on the opposite, "wheeled" side. Wheels 32 ride directly on surface 171, without a form on the left side (FIG. 7C). Referencing FIG. 5, for the application of FIG. 7C, the wheels 32 may need to be elevated. To do this they are removed from plate 75 and attached to adaptor plate 36. With the adaptor plate 36 removed from side 101 (i.e., exposing roller 120) and coupled instead to wheel mounting plate 75 (i.e., FIG. 5) to form an extension as shown, (FIG. 7C), machine 10 easily traverses the work site surface 171 without a form on the left (i.e., like form 152 in FIG. 7A or form 167 in FIG. 7B) that are no longer needed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A curb forming machine comprising:
a rigid, generally rectangular frame;
an electric motor mounted atop the frame;
a rotatable head driven by said motor and projecting beneath the frame towards raw concrete, the axis of rotation of said motor and said head being perpendicular to the slab and said frame;
an adjustable subframe comprising at least one wheel for supporting the machine over at least one form, the subframe adjustably coupled to said frame;
a pivoted handle coupled to said frame for moving the machine in a desired direction; and,
wherein the frame comprises a pair of inturned edges that slidably receive and adjustably supports said subframe so that the position of said at least one wheel and the width of said machine can be varied by a user.

2. The curb forming machine as defined in claim 1 further comprising a roller on a machine side opposite said subframe for riding on an opposite curb form.

3. The curb forming machine as defined in claim 2 wherein said motor is secured to a mounting plate that is adjustably secured to the frame, the mounting plate secured by fasteners extending into follower slots defined in the frame.

4. The curb forming machine as defined in claim 3 wherein the handle is offset from the machine center to aid in operator control.

5. The curb forming machine as defined in claim 1 wherein the shaping head has a body substantially in the shape of an inverted, truncated cone, and an integral, convex cap portion that projects downwardly.

6. A hand operated curb forming machine comprising:
a rigid, generally rectangular frame having downwardly depending front and rear edges;
a rigid, subframe supporting a pair of wheels that is adjustably, slidably coupled to the frame between said depending front and rear edges;
said wheels adapted to ride on a first form of a first height for curb work;
an electric motor mounted atop the frame;
a rotatable head driven by said motor and projecting beneath the frame towards raw concrete, the axis of rotation of said motor and said head being perpendicular to said frame;
a handle coupled to said frame for moving the machine in a desired direction;
a roller on a side of the frame opposite said riding wheels that rides on a second form that is higher than said first form;
a removable and adjustable adaptor plate that normally supports the machine when not in use and which can be removed to expose said roller to ride on said second form for normal curb work and for monolithic curbs with rebar.

7. The curb forming machine as defined in claim 6 wherein the shaping head has a body substantially in the shape of an inverted, truncated cone, and an integral, convex cap portion that projects downwardly.

8. The curb forming machine as defined in claim 6 wherein the motor outputs to a drive plate with a central hub receiving a shaft projecting from said motor, and the shaping head comprises an integral, circular ring shaped flange that is fastened to said drive plate.

9. The curb forming machine as defined in claim 6 wherein the motor is attached to a motor mounting plate that is adjustably secured to the frame, the mounting plate secured to said machine by fasteners extending into follower slots defined in the frame.

10. The curb forming machine as defined in claim 6 wherein:
the subframe is moved relative to the frame by a hand-operated adjustment knob;
the knob drives a threaded shaft;
the shaft threadably engages a traveler; and,
the traveler has a shaft connected through a follower slot to said subframe.

11. A hand operated curb forming machine comprising:
a rigid, generally rectangular frame having downwardly depending front and rear edges;
a rigid, subframe supporting a pair of wheels that is adjustably, slidably coupled to the frame between said depending front and rear edges;
said wheels adapted to ride on a first form of a first height for normal curb work;
an electric motor mounted atop the frame;
a rotatable head driven by said motor and projecting beneath the frame towards raw concrete, the axis of rotation of said motor and said head being perpendicular to said frame;
a handle pivotally coupled to said frame for moving the machine in a desired direction;
a roller on a side of the frame opposite said riding wheels that rides on a second form that is higher than said first form;

a removable and adjustable adaptor plate that normally supports the machine when not in use and which can be removed to expose said roller to ride on said second form, the adaptor plate adapted to be coupled to said subframe for elevating the machine by lowering said wheels for installing monolithic curbs without rebar.

12. The curb forming machine as defined in claim 11 wherein the shaping head has a body substantially shaped like an inverted, truncated cone, and an integral, convex cap portion that projects downwardly.

13. The curb forming machine as defined in claim 11 wherein the motor outputs to a drive plate with a central hub receiving a shaft projecting from said motor, and the shaping head comprises an integral, circular ring shaped flange that is fastened to said drive plate.

14. The curb forming machine as defined in claim 11 wherein the motor is attached to a motor mounting plate that is adjustably secured to the frame, the mounting plate secured to said machine by fasteners extending into follower slots defined in the frame.

15. The curb forming machine as defined in claim 14 wherein:

the subframe is moved relative to the frame by a hand-operated adjustment knob;

the knob drives a threaded shaft;

the shaft threadably engages a traveler; and, the traveler has a shaft connected through a follower slot to said subframe.

16. The curb forming machine as defined in claim 15 wherein the shaping head has a body substantially in the shape of an inverted, truncated cone, and an integral, convex cap portion that projects downwardly.

17. The curb forming machine as defined in claim 16 wherein the motor outputs to a drive plate with a central hub receiving a shaft projecting from said motor, and the shaping head comprises an integral, circular ring shaped flange that is fastened to said drive plate.

* * * * *